United States Patent [19]

Purvis et al.

[11] Patent Number: 4,708,088

[45] Date of Patent: Nov. 24, 1987

[54] SPRAYING METHOD AND APPARATUS

[76] Inventors: Gene Purvis, 7704 Grensted, Lawton, Okla. 73505; Russell Phelps, 106 N. 6th St.; Tim Dupler, 2100 S. 4th St., both of Lawton, Okla. 73501

[21] Appl. No.: 704,527

[22] Filed: Feb. 22, 1985

[51] Int. Cl.[4] ..... B05B 15/06

[52] U.S. Cl. ..... 118/300; 239/89; 239/322

[58] Field of Search ..... 427/421; 118/300; 239/322, 89

[56] References Cited

U.S. PATENT DOCUMENTS

| | | | |
|---|---|---|---|
| 2,763,575 | 9/1956 | Bede | 427/422 |
| 3,321,110 | 5/1967 | Price | 222/389 |
| 4,093,123 | 6/1978 | Maran | 239/322 |
| 4,147,282 | 4/1979 | Levy | 239/322 |

FOREIGN PATENT DOCUMENTS

| | | | |
|---|---|---|---|
| 123538 | 2/1947 | Australia | 239/322 |
| 2629438 | 2/1977 | Fed. Rep. of Germany | 239/322 |

OTHER PUBLICATIONS

"Pesticide Application Equipment," pp. 4–10–4–13.
"Tobul Piston Type Accumulators," Bulletin A500-/1-82 pp. 1-6.
"1984 Agricultural Chemical Label Book," (8th Edition) pp. 47-54.
"Foggers, ULV Sprayers," *Estes Chemicals Inc.,* Catalog (May, 1983), pp. 21-23.
"Pest Control Technology," (Jan. 1978), p. 28.
"Sorensen Sprayers, Inc.," (Catalog, 1984), pp. 6-8.
"Fogmaster-7401 Micro-Jet ULV Fogger," *The AFA Corporation,* 5M (6/81).

*Primary Examiner*—Shrive P. Beck
*Attorney, Agent, or Firm*—Schwartz, Jeffery, Schwaab, Mack, Blumenthal & Evans

[57] ABSTRACT

An apparatus for spraying paint in which paint is introduced into the inlet side of a powder-driven pump and the paint or other liquid is maintained above or at approximately 400 psi with power-driven pump. Pressurized paint or other liquid is then accumulated in an accumulator vessel such that, after initial pressurization of the accumulation, the pressure in the accumulator is always greater than or equal to approximately 400 psi during spraying. Communication is effected between the accumulator and a spray head, which head is located remotely from the power-driven pump. The paint or other liquid is throttled through small orifice in the spray nozzle while crating, with the small orifice, a localized pressure of at least 100 psi at the upstream side of the small orifice. The paint or other liquid is discharged through the spray head and directed toward an object to be sprayed, so that the object receives a coating of paint or other liquid via an airless spray.

4 Claims, 7 Drawing Figures

SPRAYING METHOD AND APPARATUS

BACKGROUND OF THE INVENTION

1. Field of the Invention

The present invention relates to a spraying method and apparatus, and particularly to a readily transportable, compact, power driven, airless spraying method and apparatus.

2. Description of the Prior Art

A commonly used conventional spraying system entrains a liquid to be sprayed, such as paint, in compressed air to break up the liquid into small droplets and spray it toward an object. A considerable disadvantage of such systems is relatively heavy equipment needed as well as considerable overspray problems. The overspray is both costly and dangerous. It is costly because it is wasteful of the liquids to be sprayed. It is dangerous in the context of paint spraying, for example, since it tends to fill the air with paint particles, creating an unhealthy environment for human respiration as well as a danger of explosion. In spraying pesticides, the overspray is also dangerous for respiratory reasons as well as drifting of the pesticides to areas where they are not intended to be used.

While airless spraying systems have been devised to help overcome some of these problems, conventional airless systems have their own drawbacks and disadvantages. Large, permanently installed, industrial-type airless systems are very costly and inflexible. Smaller portable airless systems tend to be inadequate. For instance, some portable systems incorporate a liquid pump into the spray head which, in turn, results in a pulsating spray. Such a pulsating spray produces an unevenness of application, particularly in the context of painting automobiles, and is therefore unsuitable for use in that context. Similarly, in the context of painting automobiles and in other analogous contexts, it often becomes necessary to turn the spray gun sideways or even upside down to apply paint properly to all surfaces. With most commercially available portable airless spray systems, this is not possible.

OBJECTS OF THE INVENTION

It is accordingly an object of the invention to overcome the disadvantages, drawbacks and dangers of conventional spraying systems and to provide a practical, safe, useful, power driven, transportable or portable spraying system which is capable of being used in many different contexts.

It is a further object of the invention to provide a compact, power driven, transportable or portable spraying system which is particularly suitable for painting of automobiles.

It is yet another object of the invention to provide a compact, power driven, transportable or portable spraying system which is simple, economical to construct, and economical and easy to use.

It is yet another object of the invention to provide a compact, power driven, transportable or portable spraying system in which the spray is produced at a relatively constant pressure without pulsation.

It is yet another object of the present invention to provide a compact, simple and relatively inexpensive power driven spraying system which is transportable or portable and yet which achieves very high pressures in the liquid to be sprayed.

It is yet another object of the present invention to provide a compact, simple and relatively inexpensive power driven spraying system which is transportable or portable and yet which provides a static charge on the spray particles without the application of any external source of electricity to create such a charge.

It is yet another object of the present invention to provide a compact, simple and relatively inexpensive power driven spraying system which is transportable or portable and yet which is capable of achieving excellent coating results with ultra low volumes of liquid as compared with conventional systems.

It is still a further object of the invention to provide a method, apparatus and system of spraying in which a lubricant for a sliding piston within an accumulator is isolated from the expansible chamber of the accumulator containing the liquid to be sprayed and from the energy storing section of the accumulator.

Other objects, features and advantages of the present invention will become more apparent from the following description and from the accompanying drawings.

SUMMARY OF THE INVENTION

The foregoing objects, features and advantages of the present invention are accomplished by providing a method and apparatus for spraying paint in which paint is introduced into the inlet side of a power-driven pump and the pressure of the paint or other liquid is maintained above or at approximately 400 psi with the power-driven pump. Pressurized paint or other liquid is then accumulated in an accumulator vessel such that, after initial pressurization of the accumulator, the pressure in the accumulator is always greater than or equal to approximately 400 psi during spraying. Communication is effected between the accumulator and a spray head, which head is located remotely from the power driven pump. The paint or other liquid is throttled through a small orifice in the spray nozzle while creating, with the small orifice, a localized pressure of at least 1000 psi at the upstream side of the small orifice. The paint or other liquid is discharged through the spray head and directed toward an object to be sprayed, so that the object receives a coating of paint or other liquid via an airless spray. To enhance the attraction of the paint or other liquid to the object to be coated and to further reduce overspray, a positive charge is established on the paint or other liquid to be discharged through the spray nozzle. This establishing of the positive charge is accomplished by the step of throttling the liquid or other paint through the small orifice of the spray head without any need for applying an outside source of electrical energy.

DETAILED DESCRIPTION OF THE PREFERRED EMBODIMENT

Figure 1:
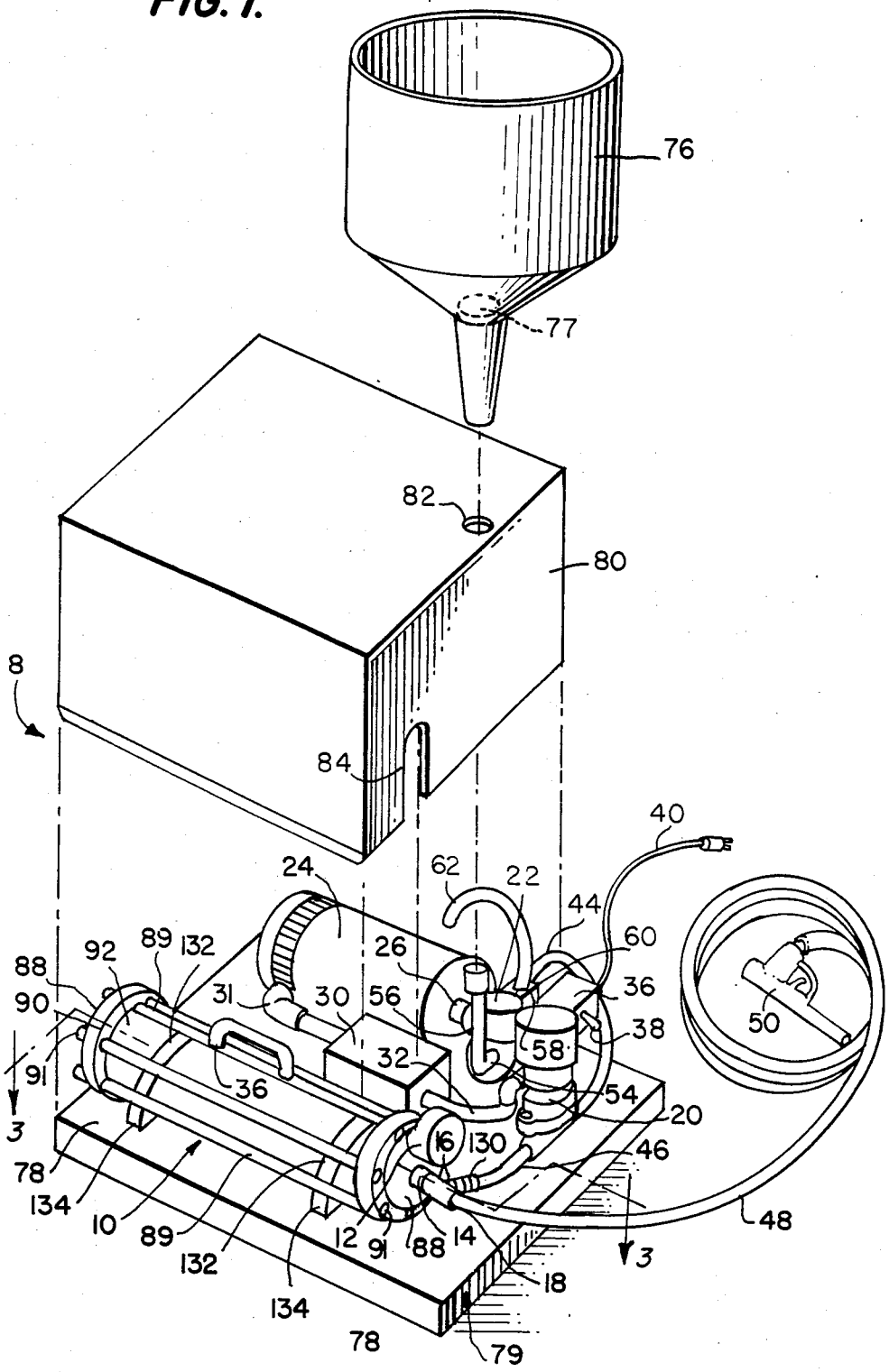
FIG. 1 is a perspective view of a spraying system according to the present invention.

Referring to FIG. 1, there is depicted a spraying system generally referred to by reference numeral 8. This spraying system 8 includes a pressure accumulator vessel 10. Adjacent the front end of the accumulator 10 is a pressure gauge 12. Pressure gauge 12 is connected with a fluid coupling 14 which, in turn, communicates with the interior of the accumulator 10. Coupling 14 includes a first branch 16 through which pressurized paint or other liquid is introduced into the accumulator 10 and a second branch 18 through which pressurized paint or other liquid is discharged from the accumulator.

The spraying system 8 includes an automatic adjustable pressure switch 20 which is in communication with the accumulator 10, and specifically the first branch 16 of the coupling leading thereto. Settings on the adjustable pressure switch determine the upper and lower pressure limits for the pressurized paint or other liquid stored in the accumulator 10. Pressure switch 20 is generally of the type shown in U.S. Pat. Nos. 3,786,212 and 3,911,238. Upstream of pressure switch 20 is a power driven liquid pump 22. In an actual working embodiment, pump 22 is a "Hydro 1000 psi liquid pump" which is a piston- type pump. The pump is powered by a motor 24 which in the actual, existing embodiment is a one horsepower Dayton explosion-proof electric motor. Motor 24 drives pump 22 via shaft drive 26.

Motor 24 receives electrical power via water-tight electrical box 30 which encloses the required electrical connections. A power line 31 leads from box 30 into motor 24 and another power line 32 leads from pressure switch 20 to box 30. As already indicated, pressure switch 20 regulates the pressure in accumulator 10. It does so by selectively feeding electrical power to motor 24 through lines 31 and 32 via box 30 when the pressure in the accumulator falls below a given minimum. When the pressure level reaches the maximum as set on pressure switch 20, power to motor 24 will be cut off by the pressure switch 20.

Electrical power is fed to the pressure switch 20 via electrical on-off switch box 36. Box 36 contains an actuating switch having a toggle arm 38 for turning the entire unit on and off. Power is supplied to box 36 via power supply cord 40.

It will be apparent that the accumulator 10, pressure switch 20 and pump 22 communicate with each other via hoses or conduits. Specifically, hose 44 connects pump 22 with pressure switch 20. Hose 46 connects pressure switch 20 with accumulator 10, and specifically with branch 16 of conduit 14 which leads into accumulator 10. An additional hose 48 leads to a spray gun 50 for effecting spraying of paint or other liquid. In an existing embodiment, hose 44, 46 and 48 are all rated at 2700 psi and have a ¼ inch inside diameter. All of the couplings for the hoses, including aforementioned coupling 14 with its branches 16 and 18, are, in the existing embodiment, aircraft high-pressure connectors rated at 3500 psi.

Pump 22 has an inlet 54 to which is connected a liquid fill tube 56. It is through inlet 54 that paint or other liquid is introduced into the system. Pump 22 also has an outlet side 58, and outlet 58 is coupled to relief valve 60 from which extends tube 62. Relief valve 60 is provided for safety reasons to avoid excessive pressure build-up if, for instance, pressure switch 20 were to fail. In the existing embodiment, relief valve 60 opens at 1000 psi to prevent pressure build-ups over that amount. Of course, excess liquid which is bled off if the relief valve is actuated passes through conduit 62. Relief valve 60 guards against burnout of the pump 22 and/or motor 24 in the event of excess pressure build-ups.

Figure 2:
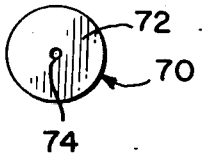
FIG. 2 is a front elevational view of a swirler containing a small orifice through which pressurized liquid is directed to effect spraying.

In the actual, existing embodiment, spray head 50 is a generally conventional DeVilbiss adjustable tip airless spray gun. The conventional gun is modified, however, to include a nozzle or spray orifice with a much smaller opening than that of the conventional spray gun. Specifically, the conventional DeVilbiss spray head 50 is fitted with a swirler 70 as shown in FIG. 2. Swirler 70 has a washer-like body 72 with a very small central orifice 74. In the existing embodiment, orifice 74 has a diameter of approximately 0.016 inch. In practice, it is expected that the desired performace can be obtained with orifices in the range of 0.010 inch and 0.025 inch.

Swirler 70 with its extra small orifice 74 creates a pressure buiid-up just upstream of itself in what is already a highly pressurized system. Specifically, with accumulator pressures in the range of 400 to 800 psi, pressure just upstream of the swirler 70 will be approximately at least 1000 psi. This high pressure and the attendant ultrahigh velocity of flow through the orifice 74 creates a finely atomized spray having a substantial positive electrical charge on the atomized particles without the need to impose an electrical charge through the use of electrical current or other application of external electrical power to the spray head. The positive charge on the finely atomized spray particles discharged from the gun 50, in turn, causes the particles to be attracted to the object to be painted or coated, which practically eliminates overspray and which permits complete coating of the object with much less paint or other liquid than would normally be required.

Reference numeral 76 refers to a hopper into which paint or other liquid may be poured. Hopper 76 connects with fill tube 56 to feed the paint or other liquid into the inlet side 54 of pump 22. Hopper 76 includes therein a filter 77 for filtering and straining the paint or other liquid fed into hopper 76.

The pump 22, its motor 24, the pressure switch 20, and the accumulator 10, as well as the components interconnecting these units, such as hoses 44 and 48, power lines 31 and 32, and electrical boxes 34 and 36, are all mounted on a base 78. Base 78 with these components thereon forms a pressure producing unit 79. As illustrated in FIG. 1, the spray head 50 may be remote from the pressure producing unit 79.

Pressure producing unit 79 may include a case 80, constructed of fiberglass, which surrounds many of the components of pressure producing unit 79 including accumulator 10, pump 22, motor 24, and electrical box 30. Case 80 is sized, however, so that, when case 80 is in place and in registry with base 78, the electrical on-off switch box 36 with its switch handle 38, the pressure switch 20 and the pressure gauge 12 will all be outside the case for easy access. Case 80 includes a slot 84 for accommodating the coupling 14 to effect communication with the interior of the accumulator 10 and an opening 82 which will be in registry with the fill tube 56 so that hopper 76 may be connected with fill tube 56 when case 80 is in place.

Figure 5:
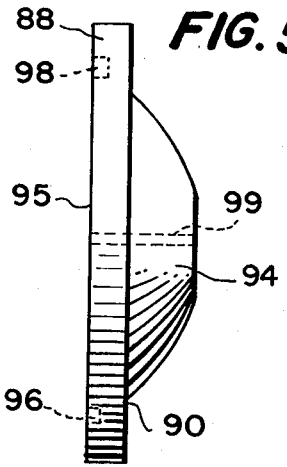
FIG. 5 is a side elevation of the cylinder head of FIG. 4.
Figure 4:
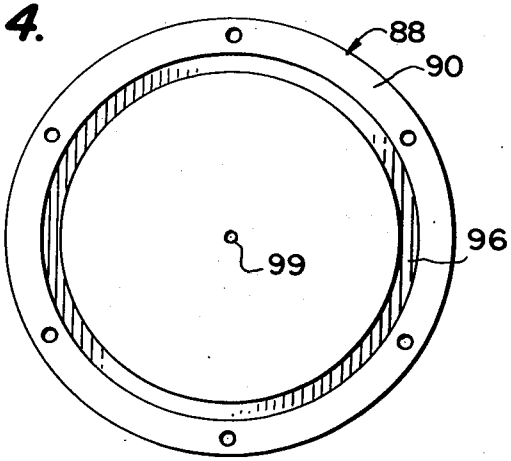
FIG. 4 is a plan view of the inside of a cylinder head which attaches to the cylinder of FIG. 3 to form the accumulator vessel.
Figure 3:
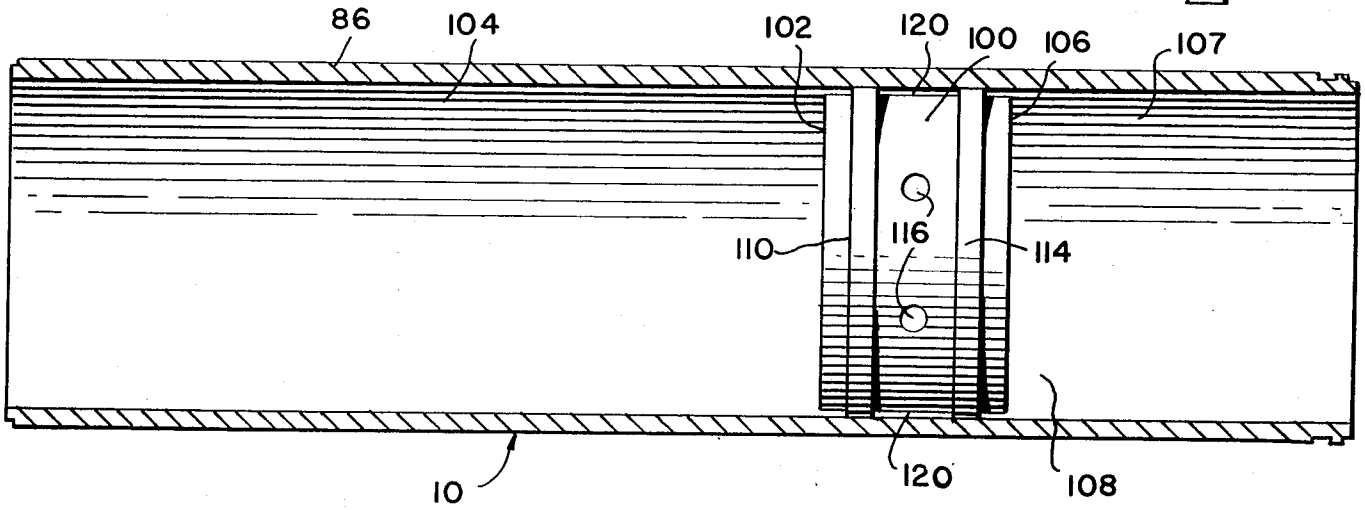
FIG. 3 is a partial sectional view taken on line 3—3 of FIG. 1 showing a section through the cylinder of the accumulator and showing the piston within the accumulator.

Turning to FIGS. 3, 4 and 5, the accumulator 10 is constructed from an elongated cylinder 86. In the existing embodiment, cylinder 86 has a diameter of 4 ½ inches with walls which are ¼ inch thick. The walls are constructed of aluminum 6061 T6. At each end of cylinder 86 is a head 88 as shown in FIGS. 4 and 5. As with the cylinders, the heads 88 are constructed of 6061 T6 aluminum. They have thickness ranges from 0.5 inch to 6875 inch. The heads 88 are firmly held in place against the high pressures developed in the cylinder 86 by a set of longitudinally extending tie rods 89. Tie rods 89 are constructed of cold rolled steel No. 1215 and have a diameter of 0.375 inch. The tie rods 81 are anchored at each end in a flange 90 on each head. The rods are held in place on flange 90 by fasteners 91 which comprise star washers with grade 5 nuts in the existing embodiment. Together, the cylinder 86 with its heads 88 held in place by tie rods 89 and fasteners 91 form a pressure vessel referred to by reference character 92.

As seen in FIG. 5, each head has a dome portion 94 for added strength. The inner portion of the head, however, i.e., the portion facing the interior of the accumulator 10, has a flat surface. This allows a complete evacuation of all liquid from the cylinder and avoids any room in the head 88 for leftover liquid when the accumulator is to be exhausted of liquid.

Each head 88 includes a groove 96 just inwardly of the flange 90, yet near the periphery of the head. Groove 96 receives the ends of the cylinder 86 therein. Groove 96 includes a gasket 98 for sealing the heads 88 with respect to the cylinder 86. The material for the gasket will be either felt, Viton, neoprene or Thycol, depending upon the liquid to be introduced into the accumulator.

Each cylinder head 88 includes a bore 99 therethrough. In the existing embodiment, the bore 99 is a 0.35 inch threaded bore. In the cylinder head at the front of the accumulator, bore 99 is for receiving coupling 14 to allow fluid communication with the interior of the accumulator. In the head 88 at the rear of the accumulator as viewed in FIG. 1, the bore 99 will allow introduction of pressurized nitrogen gas to that side of the cylinder to be used for energy storing in a manner to now be described.

In the interior of cylinder 86 is a slideable piston 100 which contributes to the energy storage function of the accumulator. Piston 100 includes a flat front side 102 partially defining an expansible chamber 104 for receiving pressurized paint or other liquid. Piston 104 also has a flat rear side 106 partially defining a chamber 107 which constitutes an energy storage section of the accumulator 10. That is, the chamber 107 constituting the energy storage section is charged with nitrogen gas under pressure. As pressurized paint or other liquid fills expansible chamber 104, it further compresses the nitrogen gas in section 107 until a desired pressure of paint or other liquid of approximately 800 psi in expansible chamber 104 is reached. As this pressurized liquid is discharged, the nitrogen gas in chamber 107 expands, releasing stored energy to provide a smooth constant pressure on the paint or other liquid being discharged and to ensure that the pressure of the paint or other liquid never drops below the desired minimum, in this instance about 400 psi.

Figure 6:
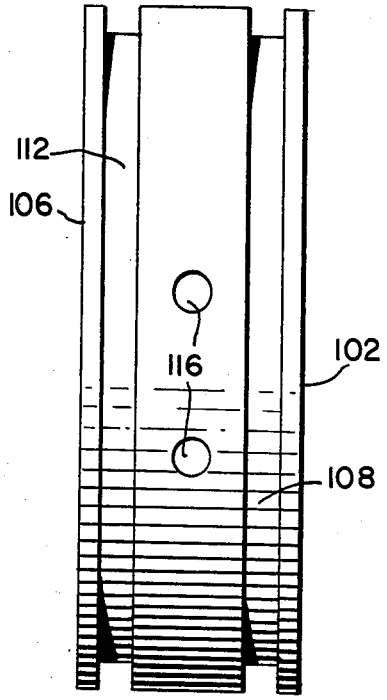
FIG. 6 is a side elevational view of the piston of FIG. 3.

Piston 100 includes a circumferential groove 108 (FIG. 6) adjacent the front side 102 of the piston. An O-ring seal 110 (FIG. 3) is disposed in groove 108. Similarly, piston 100 has, adjacent the rear side 106 thereof, a circumferential groove 112 (FIG. 6) in which an 0-ring seal 114 (FIG. 3) is disposed. According to present designs, the grooves for the O-ring seals have widths of from ⅛ inch to ¾ inch and depths of from 0.165 inch to 0.1875 inch. The O-ring seals 110, 114 may be constructed of Viton, neoprene or Thycol, depending upon the liquid to be sprayed.

Figure 7:
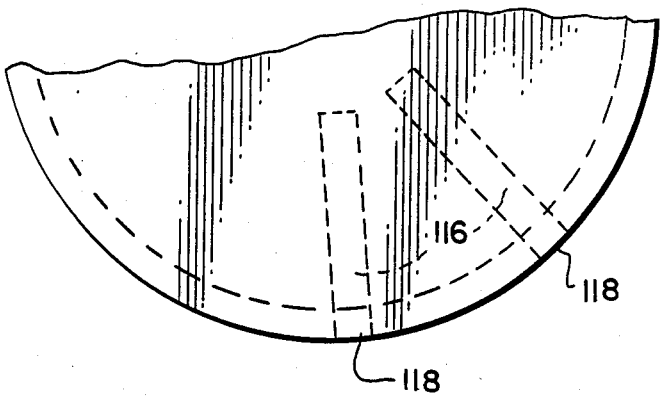
FIG. 7 is a fragmentary front elevation of the piston of FIG. 3 showing certain details thereof.

Piston 100 includes therein a series of radially inwardly extending cylindrical bores or passages 116 forming reservoirs for containing oil or another lubricant. The passages are elongated and extend inwardly for more than half the radius of the piston. For convenience, FIG. 7 illustrates only two such passages, but the passages extend entirely around the piston like spokes of a wheel. In the existing embodiment, the passages each have a diameter of 0.375 inch.

Each of the passages 116 opens into an annular lubricating space 120 between the piston 100 and cylinder 86, which lubricating space 120 is defined on its axial ends by seals 110, 114. The passages 116 defining lubricant reservoirs contain a supply of lubricant, preferably oil, therein, which lubricant is permitted to flow into lubricating space 120 to lubricate seals 110, 114. Through the use of passages 116 forming lubricant reservoirs, a long-term, self-contained supply of lubricant is provided. Also, seals 110 and 114 as well as the construction of the piston ensure that the lubricant in lubricating space 120 and passages 116 is sealed and isolated from both the expansible chamber 104 for containing pressurized paint or other liquid and from the chamber constituting the energy storing section 107. That is, there is no communication between the lubricating space 120 and chambers 104 and 107. Thus, the expansible chamber 104 and chamber constituting the energy storing section 107 are kept substantially free of lubricant.

It will be seen that the spraying system 8 shown in the drawings and described herein is a relatively small compact and easily transportable system, particularly in view of the very high pressures which the system generates and handles. A contributing factor to this is the assembly of all the components of the system, except for the spray head and the hose leading to the spray head, into a single pressure producing unit 79 as shown in FIG. 1.

To further enhance the portability of the spraying system of the present invention, the accumulator 10 may be made readily releaseable from the overall pressure producing unit 79. This is accomplished by providing a quick disconnect coupling 130 on the branch 16 of coupling 14, which coupling, it will be recalled, effects communication with the interior of the accumulator 10. By actuating quick disconnect coupling 130 to effect release of the accumulator from hose 46 leading from pressure switch 20, the accumulator 10 is then in condition to be used independently of the remainder of the pressure producing unit 79, provided of course that the accumulator has previously been charged with pressurized paint or other liquid by use of the pressure producing unit 79. The accumulator 10 may be releaseably connected to the base 78 by straps 32 having releaseable latches 34. Releasing latches 34 frees the accumulator from the base and allows it to be carried via handle 136 to whatever object or objects are to be painted or otherwise sprayed.

In other words, and as will be apparent from the foregoing and from the drawing, the straps extend between the base and the accumulator and wrap around the accumulator to secure the accumulator to the base. Each strap is connected with a releasing latch 34 for selectively tightening and loosening its associated strap. Thus, loosening of the straps frees the accumulator from the base and allows it to be carrier to a situs for painting.

In operation, when switch lever 38 is turned to the on position, motor 24 is energized to drive the pump 22. Pump 22 draws paint or other liquid from the fill tube 56 and perhaps also the hopper 76. Pressurized liquid leaving the pump passes through hose 44 and is directed to the pressure switch 20 which, in the existing embodiment, is set to continue providing power to motor 24 when the system is in an "on" cycle up to a maximum of approximately 800 psi, at which point the power to the motor is cut off. When the pressure later falls to approximately 400 psi, pressure switch 20 is set to reactuate motor 24 to drive pump 22 to raise the pressure again to 800 psi.

Liquid paint or other fluid is fed from pump 22, past pressure switch 20, through hose 46 into the accumulator 10 and specifically into the expansible chamber 104 thereof. The pressurized liquid is accumulated in the accumulator vessel 10 such that, after initial pressurization of the accumulator, the pressure in the accumulator is always approximately 400 psi or above during spraying. More specifically, as pressurized paint or other liquid is fed into expansible chamber 104, the piston 100 moves to the rear of the accumulator (i.e., to the right as viewed in FIG. 3) causing chamber 104 to expand and causing the nitrogen gas in the chamber defining energy section 107 to be compressed to store energy. The process continues until the pressure in chamber 104 reaches approximately 800 psi as sensed by pressure switch 20 and as reflected in the reading of pressure gauge 12. At 800 psi, pressure switch 20 cuts off the supply of electrical power to the motor 24, as already described.

Communication is effected between accumulator 10 and spray head 50, which head is located remotely from the power driven pump 22, by hose 48 along with coupling 14 and specifically branch 18 of that coupling. During spraying, the paint or other liquid is throttled through the small orifice 74 of the swirler 70. The swirler 70 with its small orifice 74 results in a local pressure of approximately at least 1000 psi at the upstream side of small orifice 74. Paint or other liquid is discharged through the spray head and directed toward an object to be painted or sprayed so that the object receives a coating of paint or other liquid via an airless spray. The passing of the paint or other liquid through the small orifice 74 under high pressure and at a very high velocity establishes a positive electrical charge on the paint or other liquid to be discharged through the nozzle, this charge being accomplished by the throttling of the liquid through the small orifice 74.

The accumulating of the pressurized paint or other liquid in the accumulator 10 includes isolating the pressurized paint from a lubricant which lubricates the sliding piston 100 within the accumulator 10. This is accomplished by confining the between one seal of the piston 110 which is adjacent a of the piston 102 which faces the chamber 104 of the paint or other liquid and another seal of the 4, which other seal is adjacent a side of the piston facing an energy storage section 107 of the accumulator The hose or flexible conduit 48 allows the use of the head 50 in an area remote from the accumulator 10, whi 10 is part of a pressure producing unit 79 wh includes the power driven pump 22. As already indicated of the unit may be enhanced by rendering the 10 readily detachable from the base 78 of the pressu pro unit 79. That is, the accumulator 10 may be from connection with the power driven pump via coupling 30, and the accumulator 10, hose 48 and spray head 50 may be transported to an area where painting be performed.

If painting performed with the accumulator in place on the pressure unit 79, whenever the pressure of the paint or liquid in expansible chamber 104 drops to approximate 400 psi, then the pressure switch 20 is actuated which will actuate the power driven pump 22 to reload the to approximately 800 lbs. as already described. Similarly, if the accumulator 10 has been detached from the press producing unit 79 to enhance the portability of the system and has been used at a remote location to such an extent that pressure in the expansible chamber 104 has dropped below approximately 400 psi, the accumulator 10 is reconnected to the pressure producing unit 79 and recharged in the manner just described.

During recharging, the nitrogen gas in energy storing section 107, which has been compressed further beyond its initial pressure by the movement of the piston 100 to the rear of the accumulator, then expands to help discharge the pressurized liquid from the accumulator 10 under a relatively steady pressure. When expansible chamber 104 is emptied of paint or other liquid, the nitrogen gas in section 107 forces the piston 100 to the extreme front of the accumulator to maintain an adequate pressure on the paint or other liquid even as the cylinder becomes nearly empty. That is, when the spray gun 50 is activated to release liquid, there will be a smooth, non-pulsation push exerted by the compressed nitrogen gas in section 107 even if the amount of paint or other liquid in chamber 104 is relatively small. As the piston 100 moves to the front of accumulator 10, it expands back to its original state, forcing all of the paint or other liquid out of chamber 104. With this arrangement, the spraying characteristics remain adequate and unchanged, regardless of the disposition of the spray gun 50. That is, spray gun 50 may be turned upside down or sideways without adversely affecting the spraying operation.

For charging the accumulator with paint or other liquid, the specific embodiment of the invention as disclosed herein shows the use of a hopper 76 into which paint or other liquid will be poured. In lieu of hopper 76, however, a hose or line may be run from fill tube 56 to an outside source of paint or other liquid, for instance, a 5 gallon drum, a 55 gallon drum or any other body of liquid, so as to make for a continuous feed.

The high-pressure but compact system of the present invention permits the use of much lower volumes of paint or other liquid to achieve the same results which would require higher volumes and much heavier, permanently installed equipment in conventional systems. In the system of the present invention, the operator need only handle the gun 50 which weighs about 1 lb., whereas, in a conventional airless spray system, the operator will be required to handle equipment weighing on the order of 12 lbs. The conventional system uses ½ inch I.D. hose whereas, in the present system, ¼ inch I.D. hose may be used.

It is to be recognized that the apparatus, system and method of the present invention may be used in contexts other than as specifically described herein. The present invention may be used, for instance, in asbestos encapsulating processes to apply a hermetic seal to asbestos installations and reduce the dangers of such installations. The present invention may also be used in applying fireproofing materials. Further, it may be used in the context of high-pressure washers and for striping machinery for applying stripes or lines to roads or parking lots. The portable system may be particularly appropriate for riot control as a highly selective mace applicator. The very low volumes of liquid required and the ability to direct atomized liquid exactly where intended without overspray would be particularly useful in minimizing undesirable effects of the use of mace or the like. In this regard, the present invention could also be useful as part of a security system for protection of certain buildings or areas. The present invention may also be useful as a device for injecting materials, such as liquid fertilizers or pesticides, into sprinkler systems for facilitating application of such chemicals. Further, the accumulator of the present invention, if connected with a shaft or other means for obtaining mechanical power form the movement of piston 100 could be useful as a portable energy source, such as emergency jaws which are used by fire and rescue teams for spreading jammed doors to free trapped victims or to gain access to buildings.

While the present invention has been described in connection with a specific and preferred embodiment, it will, as already discussed, be understood that various different exemplary embodiments, variations and modifications are possible. That is, the invention is not limited by the particular exemplary embodiment shown and described, and the invention covers all other possible embodiments, variations and modifications within the scope of the appended claims.

What is claimed is:

1. A portable, airless paint spraying apparatus comprising:

(a) a paint pump for pumping liquid paint, (b) a motor coupled with said pump for driving said pump, (c) said pump having an inlet for receiving unpressurized paint and an outlet for discharging pressurized paint, (d) an accumulator which communicates with said pump outlet for accumulating pressurized paint and discharging the paint under pressure, said accumulator including a pressure vessel, a piston slideable in said pressure vessel, an expansible chamber partially defined by one side of said piston, which expansible chamber is for receiving, storing and discharging pressurized paint supplied by said paint pump, and an energy storing section on the other side of said piston for storing energy from the expansion of the expansible chamber due to the introduction of pressurized paint into the expansible chamber and for releasing the energy when paint is discharged from the expansible chamber and the chamber contracts, (e) a base on which said paint pump, said motor, and said accumulator are mounted so that said base, paint pump and accumulator form a single pressure producing unit, said pressure producing unit further including:

(i) a pressure gauge connected with a fluid coupling which in turn communicates with said accumulator;

(ii) an adjustable pressure switch which determines upper and lower pressure limits for pressurized paint stored in said accumulator, said pressure switch being in communication with said accumulator;

(iii) an actuating switch with a switch handle coupled with said motor for energizing or de-energizing said motor; and (iv) a paint fill tube coupled with said paint pump for feeding paint to be pressurized into said pump, said pressure-producing unit further including a case for coupling with said base in registry therewith, which case surrounds said accumulator, said pump and said motor of said pressure producing unit; said case including an upright slot for accommodating said coupling so as to allow communication between said accumulator which is disposed within said case and said spray gun which is disposed outside said case, said case also including an opening in registry with said fill tube to allow paint which is to be pressurized to be introduced from outside said case and fed to said paint pump inside said case, said pressure gauge, said pressure switch and said actuating switch all being disposed outside said case when said case is in registry with said base so as to all be accessible from outside said case, and (f) a spray gun, separate from said accumulator and separate from said pressure producing unit, communicating with said accumulator through an elongated, flexible conduit which extends between said accumulator and said spray gun.

2. An portable 11 airless paint spraying apparatus as defined in claim 1 further comprising a quick-disconnect coupling between said power driven pump and said conduit and a releaseable retainer between said base and said accumulator, whereby said accumulator may be readily removed from said pressure producing unit and brought to a work site to effect spray painting of a work site remote from the pressure producing unit.

3. A portable airless paint spraying apparatus as defined in claim 2, wherein said releaseable retainer includes a plurality of straps which extend between said base and said accumulator and which wrap around said accumulator to secure said accumulator to said base, each strap being connected with a releasing latch for selectively tightening and loosening its associated strap, whereby loosening of said straps frees said accumulator from said base and allows said accumulator to be carried to a situs for painting.

4. A portable airless paint spraying apparatus as defined in claim 3, wherein said accumulator includes a handle to facilitate carrying of said accumulator when said accumulator has been released from said base.

* * * * *